United States Patent [19]

Yorks

[11] Patent Number: 5,051,017

[45] Date of Patent: Sep. 24, 1991

[54] CLEAR ROLL-ON BOTTLE

[75] Inventor: Charles H. Yorks, Natick, Mass.

[73] Assignee: The Gillette Company, Boston, Mass.

[21] Appl. No.: 650,958

[22] Filed: Feb. 5, 1991

[51] Int. Cl.[5] ..... A45D 34/04

[52] U.S. Cl. ..... 401/209; 401/213; 401/216

[58] Field of Search ..... 401/209, 213, 216

[56] References Cited

U.S. PATENT DOCUMENTS 2,749,566 6/1956 Thomas ..... 401/213
3,355,241 11/1967 Rowe ..... 401/213
3,752,155 8/1973 Blinoff, Jr. et al. ..... 401/216 X

FOREIGN PATENT DOCUMENTS 2412471 8/1979 France ..... 401/216

*Primary Examiner*—Steven A. Bratlie

[57] ABSTRACT

A roll-on applicator of rigid plastic material having a glass or crystal clarity is fabricated of a blow molded bottle element and an injection molded sealing ring for retaining a spherical ball in the neck of the bottle element, the ring forming the uppermost surface of the applicator and ball assembly. The product is placed in the applicator, the ball is assembled into the bottle and the ring is attached to the bottle by an ultrasonic welding process.

17 Claims, 3 Drawing Sheets

CLEAR ROLL-ON BOTTLE

BACKGROUND OF THE INVENTION

The present invention relates to a roll-on applicator and more particularly to a roll-on applicator of the type employed in dispensing a deodorant/antiperspirant type product.

One of the more common containers employed in the field of toiletries is a roll-on applicator such as employed to dispense a plurality of materials which are applied to the skin of the user. These applicators are generally manufactured of a somewhat flexible plastic material bottle having a rigid spherical ball located in the bottle opening adjacent a necked down portion forming a basket for retaining the ball. The basket portion of the bottle is generally spherical and slightly larger than the ball, and the opening is formed to be of a diameter slightly less than that of the ball. By choosing a flexible material, the rigid ball is generally capable of being forced into the basket through the flexible top opening of the bottle, and is thereafter retained by the smaller diameter opening of the bottle.

In general, the plastics having the flexibility necessary to be employed in the manufacture of these roll-on applicators do not possess a glass or crystal-type clarity but generally fall in the category of opaque to translucent appearance when provided in the thicknesses required for a roll-on applicator of the type described.

Recently, it has been suggested that a clear liquid be employed in a roll-on applicator of the type described, a clear liquid in many instances being more attractive to the user as an indication of purity of contents or lack of residue when applied to the skin. In order to best display such a product, it is therefore necessary to construct a roll-on applicator having a glass or crystal clarity such that the viewer's examination of the product not be impaired.

In the field of plastics, there are few known materials which lend themselves to mass production and the low cost required in a throw-away receptacle such as the roll-on applicator in which the clear materials are to be employed. Two such materials are polyvinyl chloride and polyethylene terephthalate material better known as PVC and PET. However, in the thicknesses required of the these materials when employed in a bottle of the type under consideration, the materials are rigid rather than flexible and therefore assembly of the ball into the container as described above becomes impossible without breakage occurring when these materials are employed.

It is therefore an object of the present invention to provide a roll-on applicator and a method of manufacturing the same wherein the applicator is of a material having a glass or crystal clarity for viewing the contents.

Another object of the invention is to provide a roll-on applicator and a method of manufacturing the same wherein the applicator is simple to manufacture from materials that are easily obtainable and are acceptable economically for employment in a discardable container designed for a single use.

Yet another object of the invention is to provide a roll-on applicator and a method of the manufacturing the same wherein the applicator is manufactured of a minimum number of parts and from a manufacturing process which is susceptible to mass production techniques.

SUMMARY OF THE INVENTION

The aforementioned objects and other objectives which will become apparent as the description proceeds are accomplished by providing a roll-on applicator which is manufactured by providing an open top bottle having a necked down portion adjacent the upper end thereof to form a radially outwardly and upwardly extending inner wall surface connecting to an upwardly extending inner wall surface substantially parallel to the axis of the bottle and terminating in the upper edge surface of the bottle opening. The bottle is filled with the product and a spherical ball is located within the inner surfaces of the bottle above the necked down portion. A circular retaining ring having a lower surface for mating engagement with the upper edge surface of the bottle opening is provided, and is located such that the lower surface of the circular retaining ring is in contact with the upper edge surface of the bottle opening. The circular retaining ring is then welded to the bottle opening upper edge by ultrasonic means.

The bottle is manufactured of a clear rigid plastic material and in the preferred embodiment is manufactured of polyethylene terephthalate material.

To facilitate the ultrasonic welding of the circular retaining ring to the bottle, the bottle is formed having an outer ring substantially rectangular in cross-section and a substantially horizontal inwardly extending area is disposed adjacent and below the top of the outer ring. The circular retaining ring lower surface comprises a recessed portion having an upper surface for receiving the top surface of the bottle upper surface in engagement and an energy directing ring substantially triangular in cross-section extends downwardly to engage the inwardly extending area of the bottle edge surface prior to the welding step. During the welding step, the energy directing ring is caused to flow between the bottle upper edge surface and the circular retaining ring lower surface with the application of pressure applied to the circular retaining ring.

The roll-on applicator of the invention comprises an open top bottle of rigid clear material having a necked down portion adjacent the upper end thereof and wall structure forming a ball retaining enclosure at the bottle open top. The wall structure comprises a radially outwardly extending inner wall connecting to an upwardly extending inner wall which is substantially parallel to the axis of the bottle and terminates in an upper edge surface of the bottle opening. A circular retaining ring having a lower surface for mating engagement with the upper edge surface of the bottle opening and an inner wall substantially parallel to the axis of the retaining ring and terminating in an inwardly extending lip at the opening is provided, the ring lower surface being affixed to the bottle upper edge surface such that the bottle inner wall is substantially parallel to the bottle axis and is in alignment with the ring inner wall to form a cylindrical cavity. An inwardly extending lip projects from the ring upper edge surface to produce an opening of lesser diameter than the cylindrical cavity and a rigid spherical ball having a diameter greater than the opening produced by the lip is disposed within the cylindrical cavity such that the upper edge surface of the bottle is in direct contact with the lower surface of the circular retaining ring with the ring affixed to the bottle. By ultrasonically welding the ring to the bottle, the bottle edge surface and the ring lower surface are sealing having no substance therebetween such as adhesive.

BRIEF DESCRIPTION OF THE DRAWING

The foregoing and other features of the invention will be more particularly described in connection with the preferred embodiment and with reference to the accompanying drawing wherein.

DESCRIPTION OF THE PREFERRED EMBODIMENT

Figure 1:
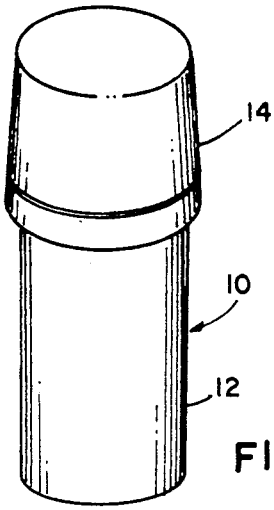
FIG. 1 is an elevational perspective view of a roll-on applicator constructed in accordance with the teachings of the present invention.
Figure 2:
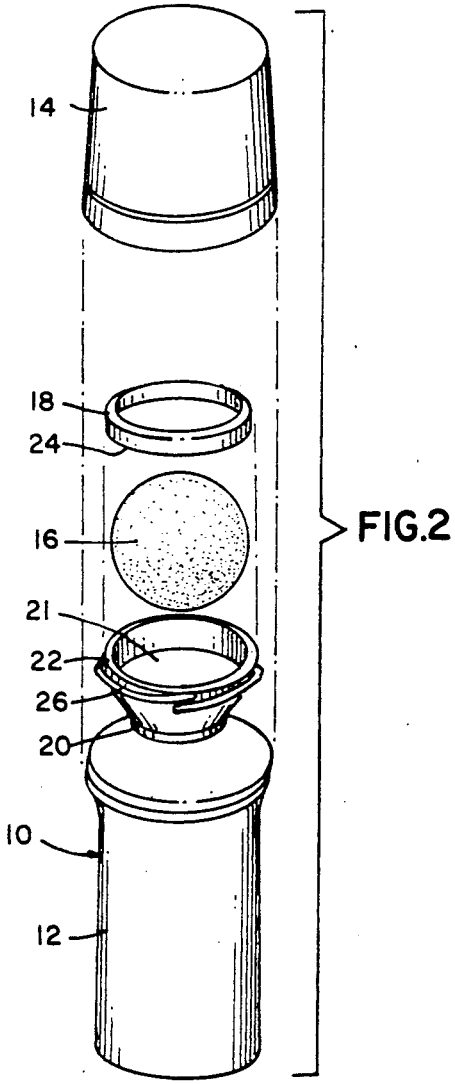
FIG. 2 is an exploded elevational perspective view of the structure of FIG. 1 showing the various components of the roll-on applicator of FIG. 1.

Referring to the drawing and in particular to FIGS. 1 and 2, there is shown a roll-on applicator 10 which in the assembled form shown in FIG. 1 comprises a bottle 12 for containing a toiletry material such as antiperspirant or deodorant and a cap 14 for sealingly engaging the opening in the bottle 12, when the applicator is not in use.

As best shown in FIG. 2, the applicator 10, in addition to the bottle 12, comprises a rigid spherical ball 16 and a retaining ring 18 of circular configuration. The wall structure of the bottle 12 comprises a necked down portion 20 which forms a basket 21 into which the ball 16 is received, and an upper edge surface 22 of the bottle 12 forming the top opening in the bottle is adapted for receiving the lower surface 24 of the circular retaining ring 18 for ultrasonic welding of the circular retaining ring to the bottle.

The cap 14 comprises an internal threaded portion (not shown) to provide a threaded attachment to the external threads 26 on the bottle, and a sealing washer (not shown) is provided within the cap to sealingly engage the cap with the upper surface of the ring 18 and ball 16 when the cap 14 is threadedly engaged onto the bottle 12.

The bottle 12 is manufactured of a polyethylene terephthalate (PET) material which is fabricated to form a minimum wall thickness in the area of 0.020 inches to produce a rigid clear plastic container. As the present construction employs ultrasonic welding of the retaining ring 18 to the bottle 12, the retaining ring is manufactured of the same material as the bottle in order to insure a satisfactory attachment of the ring to the bottle by the process.

Figure 3:
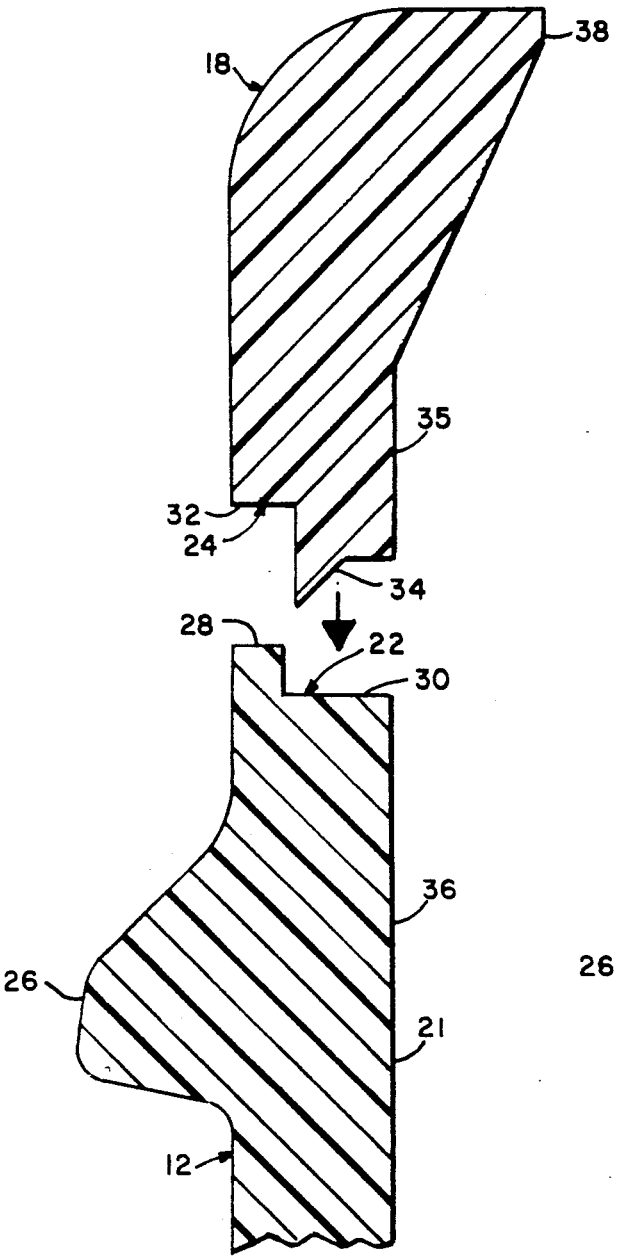
FIG. 3 is a fragmentary sectional view showing details of a portion of the structure of FIGS. 1 and 2 prior to assembly, taken on an enlarged scale for clarity.
Figure 4:
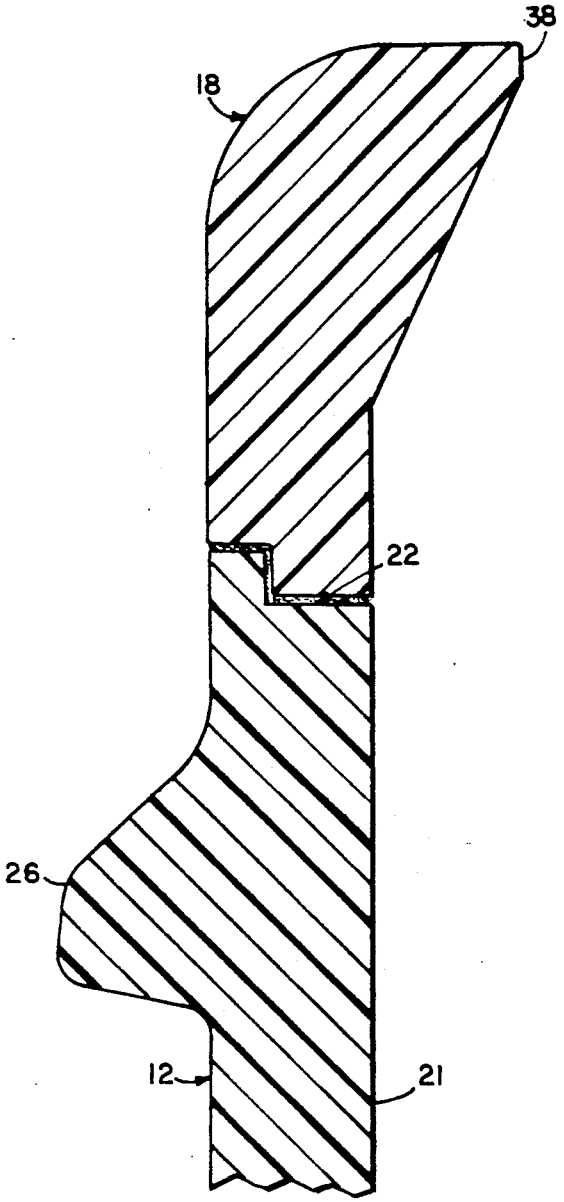
FIG. 4 is a fragmentary section view similar to FIG. 3 showing details of that portion of the structure in the assembled condition.
Figure 5:
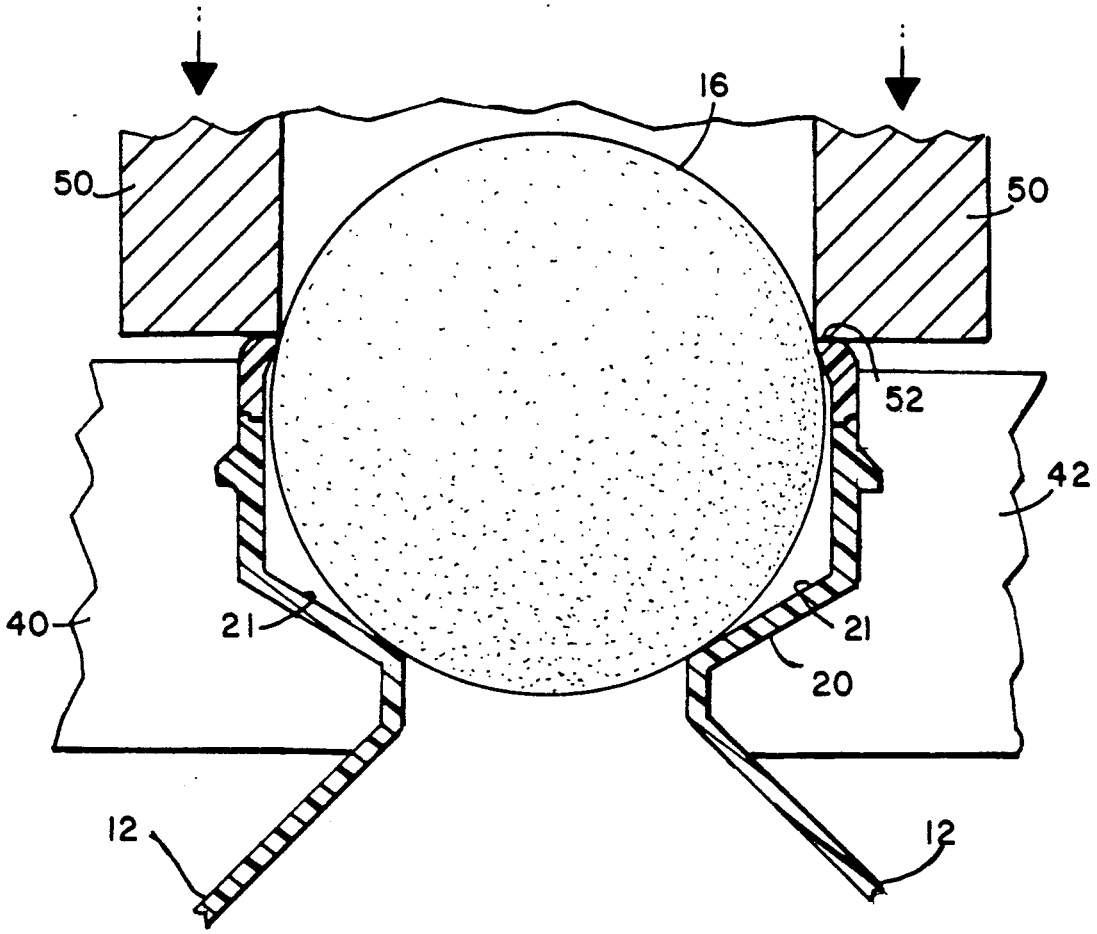
FIG. 5 is a fragmentary sectional view of the structure of FIGS. 1 through 4 showing a portion of the roll-on applicator during fabrication.

Referring now to FIGS. 3, 4 and 5 in which the upper portion of the bottle 12 and the ring 18 are shown in greater detail, the upper edge surface 22 of the bottle is formed having an outer ring 28, substantially rectangular in cross-section, and a substantially horizontal inwardly extending area 30 disposed adjacent and below the top of the outer ring. The circular retaining ring lower surface 24 comprises a recessed portion having an upper surface 32 for receiving the top surface of the outer ring 28 and an energy directing ring 34, substantially triangular in cross-section, extending downwardly to engage the inwardly extending area 30 of the bottle edge surface 22. As is evident from FIGS. 3 and 4, the basket 21 is formed by inner surfaces 35 and 36 of the retaining ring 18 and bottle 12, respectively which are in alignment to form a continuous surface when the retaining ring 18 is assembled to the bottle 12.

The retaining ring 18 further comprises an inwardly extending lip 38 which is of a lesser diameter than that of the spherical ball 16 and is effective to retain the ball within the formed basket 21 when the retaining ring 18 and the bottle 12 are assembled one to the other.

Referring now to FIG. 5, assembly of the roll-on applicator is accomplished by first filling the bottle 12 with the product to be dispensed, the filling taking place by any mass production means well known in the art, after which the ball 16 is placed into the upper opening of the bottle resting on the lower section of the basket 21 at the necked down portion 20. A clamping means in the form of a fixture having a pair of clamping elements 40 and 42 is applied adjacent the necked down portion 20 of the clamping elements 40 and 42 extending above the upper edge surface 22 of the bottle but constructed to be below the retaining ring 18 upper edge surface when positioned, thereby aiding in both clamping and aligning the retaining ring 18 with the upper edge surface 22 of the bottle 12. The retaining ring 18 is then placed in juxtaposition with the top opening of the bottle 12, as shown in FIG. 3, and the upper edge surface 22 is contacted by the energy directing ring 34 in preparation for welding of the retaining ring to the bottle. An ultrasonic welding device, which may be of any type well known in the art, is employed in attachment of the retaining ring 18 to the bottle 12, such welding devices generally comprising a ultrasonic horn which is placed in contact with the materials to be welded. In the present embodiment, a cylindrical horn 50 is constructed and disposed adjacent the clamping means such that the inner edge 52 of the horn is in contact with the lip 38 of the retaining ring 18 and does not contact the ball 16, retained within the basket 21.

With the application of energy to the ultrasonic welding device, the energy directing ring 34 is reduced to a molten state and flows inwardly and outwardly of the contact surfaces 24 and 22 to form a joint, as shown in FIG. 4, resulting in the retaining ring 18, the bottle 12 and the material forming the weld being of identical material. The location of the energy directing ring 34 approximately midway between the inner and outer surfaces of the retaining ring 18, and the dimensions of the energy directing ring are such that the material does not flow beyond the inner surface of the welded joint, or does not flow outside of the joint, and thereby provides a substantially uniform inner and outer surface of the roll-on applicator 10 in its final form.

As alluded to above, the manufacture of prior art roll-on applicators has generally been accomplished by employing a one piece somewhat flexible plastic material bottle having an opening of slightly smaller dimension than the rigid ball employed and forcing the rigid ball into the undercut at the opening to retain the ball within the basket. With the provision of the rigid clear PET material in the present invention, the process of forcing the rigid ball through the narrow opening at the top of the bottle would cause breakage of the bottle at the opening. As a solution to this problem, the present invention provides a two-part basket for ease of assembly of the ball into the application. However, by employing a two-part basket, the attachment of the elements to produce the basket becomes critical in that the use of adhesives is not desirable due to their tendency to infiltrate into the material within the bottle, causing possible contamination of the bottle contents. As will be appreciated, in the present construction, the employment of the novel two-part basket comprising the retaining ring 18 and the necked down portion 20 of the bottle 12 together with the novel construction of the upper edge surface 22 of the bottle and the lower surface 24 of the ring, in combination with the ultrasonic welding process produces a rigid clear roll-on applicator 10 which is simple to construct and is attractive when used with a clear liquid, or viscous material.

While it is apparent that modifications and changes may be made within the spirit and scope of the present invention, it is my intention, however only to be limited by the scope of the appended claims.

As my invention, I claim:

1. A method of manufacturing a roll-on applicator containing a product, comprising the steps of:

providing an open top bottle having a necked down portion adjacent the upper end thereof to form a radially outwardly and upwardly extending inner wall surface connecting to an upwardly extending inner wall surface substantially parallel to the axis of the bottle and terminating in the upper edge surface at the bottle opening;

filling the bottle with the product;

locating a spherical rigid ball within the said inner wall surfaces of the bottle;

providing a circular retaining ring having a lower surface for mating engagement with the upper edge surface of the bottle opening;

locating the lower surface of the circular retaining ring in contact with the upper edge surface of the bottle opening; and welding the circular retaining ring to the bottle opening upper edge by ultrasonic means.

2. A method of manufacturing a roll-on applicator as set forth in claim 1 wherein said bottle is manufactured of a rigid clear plastic material.

3. A method of manufacturing a roll-on applicator as set forth in claim 1 wherein said bottle is manufactured of a polyethylene terephthalate material.

4. A method of manufacturing a roll-on applicator as set forth in claim 1 wherein said bottle and said ring are manufactured of the same material.

5. A method of manufacturing a roll-on applicator as set forth in claim 1 wherein said bottle is manufactured to form a minimum wall thickness in the area of 0.020 inch.

6. A method of manufacturing a roll-on applicator as set forth in claim 1 wherein the upper edge surface of the bottle is formed having an outer ring substantially rectangular in cross-section and a substantially horizontal inwardly extending area disposed adjacent and below the top of said outer ring, and wherein said circular retaining ring lower surface comprises a recessed portion having an upper surface for receiving the top surface of said bottle upper surface in engagement and an energy directing ring substantially triangular in cross-section extending downwardly to engage said inwardly extending area of said bottle edge surface prior to the welding step whereby said energy directing ring is caused to flow between said bottle upper edge surface and said circular retaining ring lower surface by application of pressure to said circular retaining ring during the welding step.

7. A method of manufacturing a roll-on applicator as set forth in claim 6 wherein said energy directing ring is disposed inwardly of, and adjacent to, said outer ring with said bottle upper edge surface and said circular retaining ring lower surface in contact.

8. A method of manufacturing a roll-on applicator as set forth in claim 2 wherein said bottle is manufactured of a polyethylene terephthalate material.

9. A method of manufacturing a roll-on applicator as set forth in claim 8 wherein said bottle and said ring are manufactured of the same material.

10. A method of manufacturing a roll-on applicator as set forth in claim 9 wherein said bottle is manufactured to form a minimum wall thickness in the area of 0.020 inch.

11. A method of manufacturing a roll-on applicator as set forth in claim 10 wherein the upper edge surface of the bottle is formed having an outer ring substantially rectangular in cross-section and a substantially horizontal inwardly extending area disposed below the top of said outer ring, and wherein said circular retaining ring lower surface comprises a recessed portion having an upper surface for receiving the top surface of said bottle upper surface in engagement and an energy directing ring substantially triangular in cross-section extending downwardly to engage said inwardly extending area of said bottle edge surface prior to the welding step whereby said energy directing ring is caused to flow between said bottle upper edge surface and said circular retaining ring lower surface by application of pressure to said circular retaining ring during the welding step.

12. A method of manufacturing a roll-on applicator as set forth in claim 11 wherein said energy directing ring is disposed inwardly of, and adjacent to, said outer ring with said bottle upper edge surface and said circular retaining ring lower surface in contact.

13. A roll-on applicator for dispensing a product, comprising:

an open top bottle of rigid clear material having a necked down portion adjacent the upper end thereof and wall structure forming a ball retaining enclosure at the bottle open top, said wall structure comprising:

a radially outwardly extending inner wall connecting to an upwardly extending inner wall substantially parallel to the axis of the bottle and terminating in an upper edge surface at the bottle opening;

a circular retaining ring having a lower surface for mating engagement with the upper edge surface of the bottle opening and an inner wall substantially parallel to the axis of the retaining ring and terminating in an inwardly extending lip, said ring lower surface being affixed to said bottle upper edge surface such that said bottle inner wall substantially parallel to said bottle axis is in alignment with said ring inner wall to form a cylindrical cavity having said inwardly extending lip projecting thereover to produce an opening of lesser diameter than said cylindrical cavity; and a spherical rigid ball having a diameter greater than that of said opening produced by said lip disposed within said cylindrical cavity wherein said upper edge surface of said bottle is in direct contact with the lower surface of said circular retaining ring with said ring affixed to said bottle, having no substance therebetween.

14. A roll-on applicator as set forth in claim 13 wherein both said bottle and said retaining ring are fabricated of a clear rigid plastic material.

15. A roll-on applicator as set forth in claim 14 wherein said bottle and said retaining ring are formed of the same materials.

16. A roll-on applicator as set forth in claim 15 wherein said bottle and said retaining ring are manufactured of a polyethylene terephthalate material.

17. A roll-on applicator as set forth in claim 16 wherein said bottle is fabricated to form a minimum wall thickness in the area of 0.020 inch.

* * * * *